US007563123B2

(12) United States Patent
Cave

(10) Patent No.: US 7,563,123 B2
(45) Date of Patent: Jul. 21, 2009

(54) CONNECTOR RETAINERS AND METHODS OF SECURING A CONNECTOR TO A RECEPTACLE

(75) Inventor: Mark Richard Cave, Palm Harbor, FL (US)

(73) Assignee: The Nielsen Company (US), LLC, Schaumburg, IL (US)

( * ) Notice: Subject to any disclaimer, the term of this patent is extended or adjusted under 35 U.S.C. 154(b) by 26 days.

(21) Appl. No.: 11/864,161

(22) Filed: Sep. 28, 2007

(65) Prior Publication Data

US 2009/0020656 A1 Jan. 22, 2009

Related U.S. Application Data

(60) Provisional application No. 60/949,893, filed on Jul. 16, 2007.

(51) Int. Cl.
*H01R 13/62* (2006.01)

(52) U.S. Cl. ..... 439/373; 439/369; 439/370; 439/371

(58) Field of Classification Search ..... 439/369–371, 439/373, 358

See application file for complete search history.

(56) References Cited

U.S. PATENT DOCUMENTS

| | | | | |
|---|---|---|---|---|
| 2,728,058 | A | 12/1955 | Phalen | |
| 3,328,748 | A | 6/1967 | Winter | |
| 3,570,361 | A | 3/1971 | Tinnerman | |
| 3,603,913 | A | 9/1971 | Hasty, Jr. | |
| 3,622,942 | A | 11/1971 | Rynk | |
| 3,638,169 | A | 1/1972 | Caveney et al. | |
| 3,732,526 | A | 5/1973 | Punako | |
| 3,889,909 | A | 6/1975 | Koscik | |
| 3,966,292 | A | 6/1976 | Schultz | |
| 4,017,139 | A | 4/1977 | Nelson | |
| 4,927,385 | A | 5/1990 | Cheng | |
| 4,932,897 | A | 6/1990 | Lee et al. | |
| 5,308,259 | A | 5/1994 | Liao | |
| 5,338,211 | A * | 8/1994 | Kodama et al. | 439/135 |
| 5,454,729 | A * | 10/1995 | Wen-Te | 439/357 |
| 5,772,462 | A * | 6/1998 | Osten | 439/367 |
| 5,785,547 | A * | 7/1998 | Cross et al. | 439/369 |
| 5,842,450 | A * | 12/1998 | Fort et al. | 123/463 |
| 5,895,289 | A | 4/1999 | Smith | |
| 5,928,023 | A | 7/1999 | Buckner et al. | |
| 6,217,366 | B1 * | 4/2001 | Weisstock | 439/369 |
| 6,296,525 | B1 | 10/2001 | D'Addario et al. | |
| D467,492 | S * | 12/2002 | Wieder | D8/356 |
| 6,491,539 | B1 * | 12/2002 | Johnston | 439/373 |

(Continued)

OTHER PUBLICATIONS

Official Action, issued in connection with U.S. Appl. No. 11/933,920; mailed May 5, 2008 (6 pages).

(Continued)

*Primary Examiner*—Tho D Ta
(74) *Attorney, Agent, or Firm*—Hanley, Flight & Zimmerman, LLC

(57) ABSTRACT

Connector retainers and methods of securing a connector to a receptacle are disclosed. An example apparatus includes a gripping portion to engage an outer surface of a projecting portion of the receptacle; and a support extending from the gripping portion to be coupled to the connector with the gripping portion located closer to a base of the projecting portion than a sleeve contact of the connector.

20 Claims, 4 Drawing Sheets

U.S. PATENT DOCUMENTS

| | | | | |
|---|---|---|---|---|
| 6,491,541 | B2 | 12/2002 | Wakino | |
| 6,568,964 | B2 | 5/2003 | D'Addario | |
| 6,582,240 | B2 | 6/2003 | Suto | |
| 6,612,619 | B2 * | 9/2003 | Wieder | 285/23 |
| 6,745,330 | B1 | 6/2004 | Maillot | |
| 6,802,725 | B2 * | 10/2004 | Rowland et al. | 439/144 |
| 6,902,432 | B2 | 6/2005 | Morikawa et al. | |
| 7,014,493 | B1 * | 3/2006 | Battard | 439/373 |
| 7,094,099 | B2 | 8/2006 | Daggett et al. | |
| 7,135,971 | B2 | 11/2006 | Kim | |
| 7,192,308 | B2 | 3/2007 | Rodrigues et al. | |
| 7,207,823 | B1 * | 4/2007 | Yang | 439/352 |
| 2003/0224637 | A1 | 12/2003 | Ling | |
| 2004/0038581 | A1 * | 2/2004 | Brown | 439/373 |
| 2006/0107073 | A1 | 5/2006 | Lane et al. | |

OTHER PUBLICATIONS

Official Action, issued in connection with U.S. Appl. No. 11/933,920; mailed Aug. 21, 2008 (9 pages).

Official Action, issued in connection with U.S. Appl. No. 11/933,920; mailed Dec. 24, 2008 (8 pages).

Official Action, issued in connection with U.S. Appl. No. 11/933,920; mailed Feb. 25, 2009 (6 pages).

* cited by examiner

CONNECTOR RETAINERS AND METHODS OF SECURING A CONNECTOR TO A RECEPTACLE

RELATED APPLICATION

This application claims priority from U.S. provisional patent application Ser. No. 60/949,893, filed on Jul. 16, 2007, entitled "Connector Retainers and Methods of Securing a Connector to a Receptacle."

TECHNICAL FIELD

The present disclosure pertains to optical and electrical connectors and, more particularly, to connector retainers and methods of securing a connector to a receptacle.

BACKGROUND

Many types of cables, such as RCA (Radio Corporation of America) cables, are used to electrically and/or optically connect components. For example, RCA cables are commonly used to connect peripheral devices to televisions and/or computers. Cables are commonly terminated in connectors that are specifically designed for connection to receptacles, also referred to as jacks or ports. The ports may be constructed in any of a number of ways. For example, a port may be mounted behind a housing panel, mounted within a housing, or be an integral part of a housing. Irrespective of its precise structure and location, these ports are typically intended to receive a connector of a specific type via a male-female type connection. If, after a connector is seated in a port, the connector and/or cable is bumped or otherwise subjected to a force and/or vibration, the connector may be accidentally disconnected from the corresponding jack. Such inadvertent disconnection of a connector from a port can result in inconvenience, power loss, and/or loss of data.

DETAILED DESCRIPTION

Although the following discloses example retainers for retaining an RCA type connector (also referred to as a phono connector or CINCH/AV connector) in a corresponding jack or port, persons of ordinary skill in the art will appreciate that the teachings of this disclosure are in no way limited to such connectors, jacks, and/or ports, and that the teaching of this disclosure are in no way limited to use with any particular type of housing or electronic device. On the contrary, it is contemplated that the teachings of this disclosure may be implemented in alternative environments of use such as for use with other types of connectors and/or ports (e.g., optical fiber connectors and/or ports, etc.). For example, although the example retainers described herein are described in conjunction with connectors having cords or cables connected thereto, those having ordinary skill in the art will readily recognize that the example retainers may be used with devices that do not have cables or cords. Similarly the disclosed examples may be used with any type of optical and/or electronic device. For instance, a disclosed example retainer may be used to secure a connector (e.g., a RCA connector) to a television, to stereo equipment, to any type of electronic entertainment device (e.g., a set top box (STB), a DVD player, etc.), to a laptop computer, to a desktop computer, to a server, to an audience measurement device (e.g., a people-meter, a tuning meter, a code and/or signature collector, etc.), and/or to a portable electronic device such as a cellular telephone, an MP3 player (e.g., an ipod), a personal digital assistant (PDA), a camera and/or to any other type of device to establish and/or maintain an electrical and/or optical connection with another device. Thus, the methods, apparatus, and/or articles of manufacture disclosed herein may be advantageously adapted to enhance or improve the retention of any type of electrical and/or optical connector in any type of electrical and/or optical receptacle (e.g., ajack or port) associated with any type of device. Accordingly, while the following describes example retainers and methods, persons of ordinary skill in the art will readily appreciate that the disclosed examples are not the only way to implement such retainers and/or methods.

In general, the example retainers and/or methods described herein assist in retaining a connector in a receptacle (e.g., a jack or port) even when the connector and/or a cable or device associated with the connector is subjected to a force which, in the absence of the retainer, would remove the connector from the port.

Figure 1:
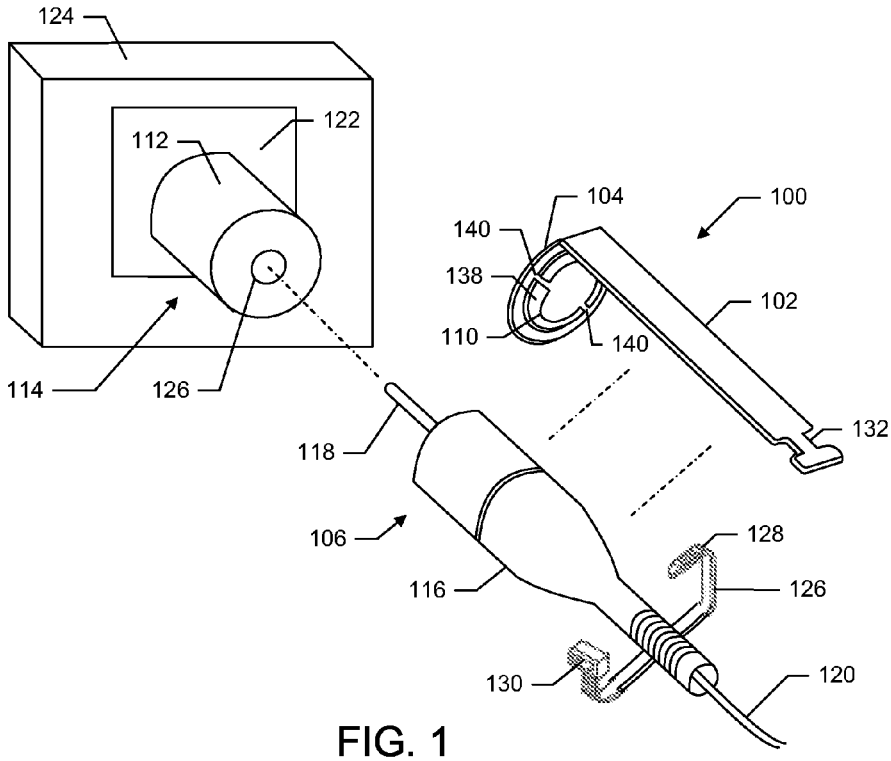
FIG. 1 is an exploded perspective view of a first example retainer to secure a first example connector in a first example port.

A first example retainer 100 is illustrated in FIG. 1. The illustrated example retainer 100 includes a support body 102 and a gripping portion 104. The support body 102 comprises an arm extending from the gripping portion 104 to couple the retainer 100 to a connector 106. The gripping portion 104 comprises an annular body with an inner surface 110 to engage an outer surface 112 of a receptacle or jack 114. As discussed further below, the inner surface 110 provides a frictional resistance to the disengagement of the connector 106 from the receptacle 114.

Figure 1A:
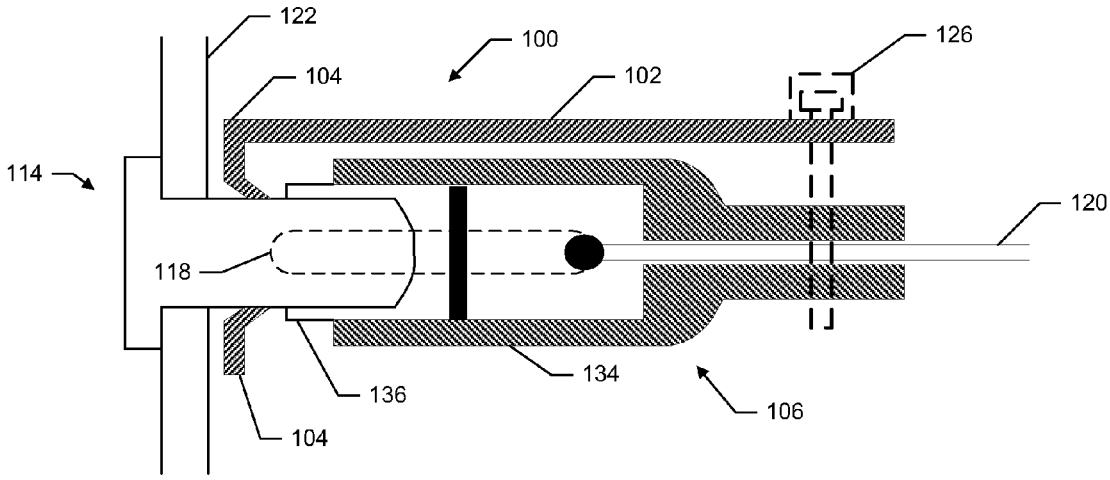
FIG. 1A is a cross sectional view of the first example retainer and the first example connector secured to the first example port.

The retainer 100 in FIG. 1 is shown in use with an RCA type connector 106. The connector 106 of the illustrated example includes a housing portion 116 and an interconnect portion 118 coupled to a cable 120 extending opposite the interconnect portion 118. In the example of FIGS. 1 and 1A, the connector 106 is shown cooperating with a corresponding RCA type receptacle or jack 114. In this example, the jack 114 is mounted to a housing panel 122 of a housing 124 of an electronic device (not shown). To couple the connector 106 to the jack 114, the interconnect portion 118 engages an opening 126 in the jack 114 to make electrical connection therewith.

To utilize the retainer 100, the retainer 100 may be coupled to the connector 106 via, for example, a fastener 126. The fastener 126 in FIGS. 1 and 1A is implemented as a plastic cable tie having a toothed band 128 insertable through a securing portion (e.g., a locking ring) 130 of the band 128. However, any other fastener (e.g., an elastic band, a twist tie, etc.) may be used in place of, or in addition to, the fastener 126. The band 128 of the cable tie 126 may be wrapped around the connector 106 and the end of the toothed band 128 may be pulled through the locking ring 130 to tighten the band 128 on the connector 106 such that the cable tie 126 secures the retainer 100 to the connector 106. Connection to the connector 106 may be affected either via the housing portion 116 or the cable portion 120. The connector 106 may be removed by cutting the fastener 126, or if the fastener 126 is of a releasable type, by releasing, for example, the toothed band 128 from the locking ring 130.

The support body 102 may include notches 132 dimensioned to receive the fastener 126. Although the illustrated example employs a pair of notches 132, persons of ordinary skill in the art will readily appreciate that a different amount of notches (e.g., 0, 1, 3, etc.) may be used. Coupling the retainer 100 to the connector 106 using a removable fastener (e.g., the fastener 126 of FIG. 1) as described above allows the retainer 100 to be retroactively used on existing connectors.

As shown in the example of FIG. 1A, the connector 106 may include an outer sleeve 134 and/or a contact sleeve 136 (e.g., a conductive cylinder) to provide, for example, a ground contact. The jack 114 receives (e.g., through the opening 126 of FIG. 1) the interconnect portion 118, which is operatively coupled to the cable 120 within the connector 106. In the example of FIG. 1A, the contact sleeve 136 is dimensioned to make contact with the outer surface 112 of the jack 114 (e.g., to provide a ground). In some examples, the contact sleeve 136 may extend beyond the outer sleeve 134. In other examples, the outer sleeve 134 may extend beyond the contact sleeve 136, or the two sleeves may extend a substantially equal distance.

The retainer 100 is coupled to the connector 106 in a manner to allow the gripping portion 104 to engage the jack 114 in front of the connector 106. In other words, when the combined assembly of the retainer 100 and the connector 106 is engaged with the jack 114, the gripping portion 104 is positioned beyond the connector 106, in contact with the outer surface 112 of the jack 114. For example, where the retainer 100 is coupled to the connector 106 before either the retainer 100 or connector 106 is engaged with the jack 114, the gripping portion 104 slides onto the outer surface 112 of the jack 114 ahead of any sleeve (e.g., the contact sleeve 140 and/or the outer sleeve 134) of the connector 106. In some examples, the retainer 100 may be engaged with the jack 114 before being coupled to the connector 106 and before the connector 106 is engaged with the jack 114. For example, the gripping portion 104 of the retainer 100 may be slid onto the outer surface 112 of the jack 114. Then, the jack 114 may receive the connector 106 (i.e., the interconnect portion 118 is received by the opening 126 and the housing portion 116 is slid over the outer surface 112 of the jack). Then, the retainer 100 may be secured to the connector 106 (e.g., via the fastener 126). It will be appreciated that other methods of assembling the retainer 100 and connector 106 and engaging each with the jack 114 are also possible.

Regardless of the order or method in which the components are assembled, when engaged with the jack 114, the retainer 100 prevents or substantially reduces the occurrence of accidental disengagement of the connector 106 from the jack 114. As mentioned above, the frictional engagement between the inner surface 110 of the gripping portion 104 and the jack 114 resists disengagement of the retainer 100 from the jack 114. More specifically, the inner surface 110 is configured to provide a greater resistance to disengagement of the connector 106 than the frictional resistance between the connector 106 and the jack 114. While the inner surface 110 of the gripping portion 104 prevents accidental disengagement when subjected to forces below a certain level, the inner surface 110 allows the retainer 100 to be slid onto the jack 114 with relatively little effort.

In some examples, the inner surface 110 of the gripping portion 104 includes one or more serrated barbs 138 to engage the outer surface 112 of the jack 114. As shown in FIG. 1A, the barbs 138 of the illustrated example are separated by gaps 140 and angled away from the gripping portion 104 (i.e., towards the connector 106). In other examples, the inner surface 110 may include a single continuous barb (i.e., without the gaps 140). The angular configuration allows the gripping portion 104 to be slid onto the jack 114 without undue resistance. However, when a removal force is applied to the connector 106 and/or the retainer 100, the barbs 138 may dig into or apply a frictional force to the outer surface 112 of the jack 114.

Figure 1B:
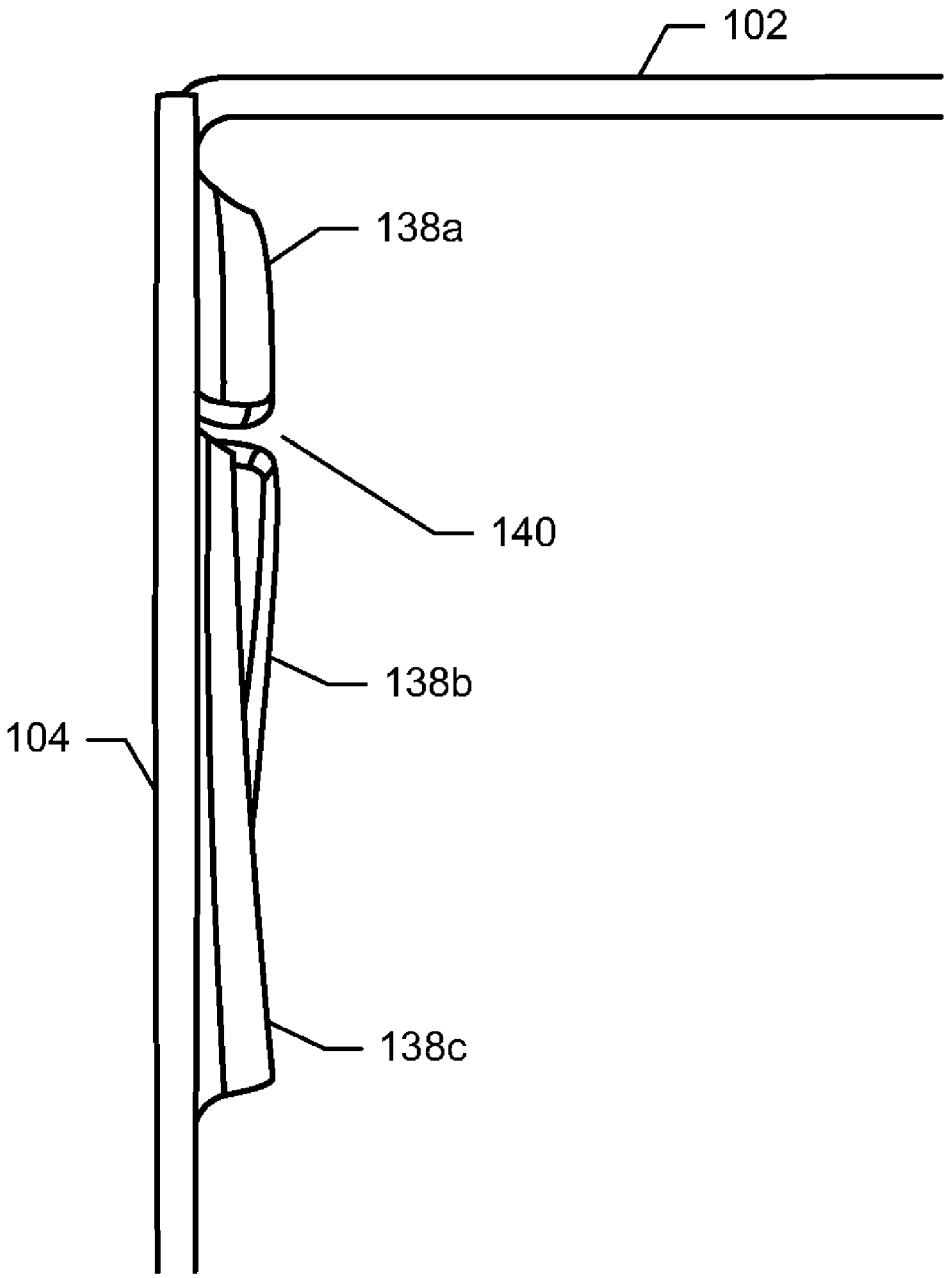
FIG. 1B is a profile view of an example retainer.

Additionally or alternatively, as shown in FIG. 1B, the barbs 138, separated by a plurality of gaps 140, may be arranged in a helical configuration (e.g., to create a thread) to allow a user to remove the retainer 100 in a twisting motion. In other words, the helical configuration, in combination with the gaps 140, give the user the option of unscrewing the retainer 100 from the jack 114, thereby overcoming the disengagement resistance created by the gripping portion 104.

With the retainer 100 installed, inadvertent disconnection or removal of the connector 106 from the jack 114 is less likely to occur. Therefore, electrical or optical connectivity is maintained between the interconnect portion 118 of the connector 106 and the jack 114, even when the connector 106 is subjected to jostling or other removal force. Assembly of the example retainer 100 to the connector 106 readily permits intentional removal of the connector 106 from the jack 114 by, for example, disconnecting the retainer 100 from the connector 106. The strength of the pull out force required to overcome the retention capability of the retainer 100 is implementation dependent (e.g., it depends on features such as material strength, etc.). The material of the retainer 100 may be selected to yield when subjected to a fairly substantial removal force so as to avoid damage to the connector 106, the jack 114, or electrical device while still performing the retention function in response to the application of most inadvertent removal forces.

Figure 2:
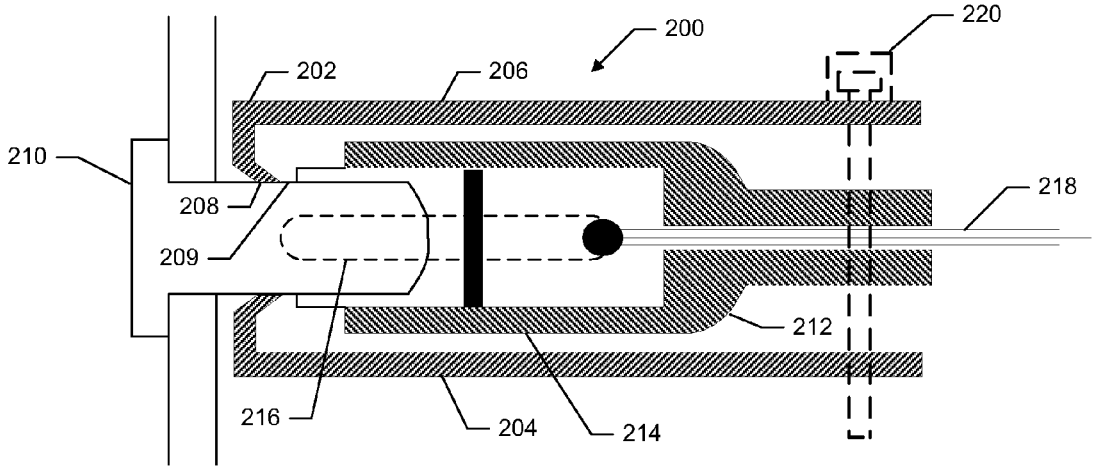
FIG. 2 is a cross sectional view of a second example retainer and a second example connector secured to a second example port.

FIG. 2 illustrates another example retainer 200. In this example, the retainer 200 includes a gripping portion 202, a first support body 204, and a second support body 206. The gripping portion 202, similar to the gripping portion 104 of FIG. 1, comprises an annular body with an inner surface 208 to engage an outer surface 209 of a receptacle or jack 210. Similar to the support body 102 of FIG. 1, each support body 204 and 206 comprises an arm extending from the gripping portion 202 to couple the retainer 200 to a connector 212. In this example, the support bodies 204 and 206 are positioned substantially parallel along the annular gripping portion 202. However, alternative configurations are possible. Furthermore, other examples may include more than two support bodies and/or support bodies having different orientations and/or configurations.

As in FIG. 1, the connector 212 in this example includes a housing portion 214 and an interconnect portion 216 coupled to a cable 218 extending opposite the interconnect portion 216. To couple the connector 212 to the jack 210, the interconnect portion 216 engages an opening (e.g., the opening 126 of FIG. 1) in the jack 210 to make electrical connection therewith.

To utilize the retainer 200, the retainer is coupled to the connector 212. As in FIG. 1, the coupling is affected via a fastener 220, which, although shown as a plastic cable tie in FIG. 2, may be implemented as any other suitable fastener (e.g., an elastic band, a twist tie, etc.). In the example of FIG. 2, both the first and second support bodies 204, 206 are coupled to the connector 212. The second support body 206 may provide additional gripping support during engagement or disengagement of the connector 212 to and from the jack 210. In other words, including multiple support bodies may make it easier to grip the retainer 200 and balance the load experienced by the retainer 200 during removal and/or installation. Further, the first and/or second support bodies 204 and 206 may include at least one notch (not shown) dimensioned to receive the fastener 220.

As described above in connection with FIG. 1, when engaged with the jack 210 and coupled to the connector 212, the retainer 200 reduces the likelihood of accidental disengagement of the connector 212 from the jack 210 due to the frictional engagement between the inner surface 208 and jack 210. The retainer 200 may be readily removed if desired, and/or may be designed to yield under a particular level of removal force. Also, as explained above, the retainer 200 may be coupled to the connector 212 before either the retainer 200 or the connector 212 is engaged with the j ack 210, or the retainer 200 may be engaged with the jack 210 before the connector 212 is coupled to the retainer 200 and/or jack 210.

Figure 3:
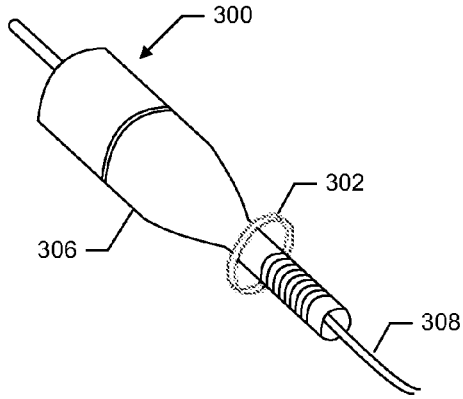
FIG. 3 illustrates an example fastener for use with an example connector.
Figure 3A:
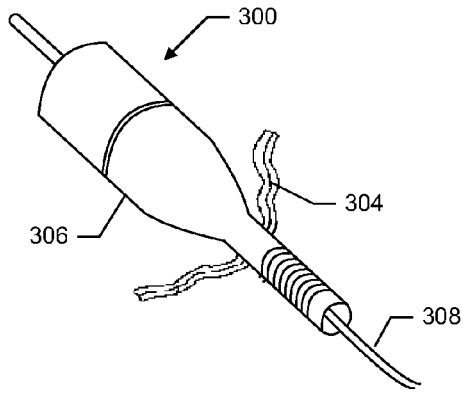
FIG. 3A illustrates another example fastener for use with an example connector.

FIGS. 3 and 3A illustrate example alternative fasteners to couple the example retainers described herein to a connector 300. The fastener 302 in FIG. 3 comprises a continuous elastic band. In the example of FIG. 3, the fastener 302 is connected to the connector 300 and a retainer (e.g., the example retainer 100 of FIG. 1 or the example retainer 200 of FIG. 2) by disposing the fastener 302 within, for example, a notch or notches (e.g., the notches 132 of FIG. 1) in the retainer and tightly encircling the connector 300. The example fastener 304 shown in FIG. 3A comprises a twist tie having a wire encased in a plastic ribbon. In this example, the fastener 304 is looped through, for example, a notch or notches in the retainer, up and around the connector 300, and then the two loose ends of the fastener 304 are twisted together to retain the connector 300.

In both FIGS. 3 and 3A, if a retainer does not include a notch, the fastener 302 or 304 may be readily fastened to any suitable portion of the retainer. For example, as mentioned above, regardless of the presence of notches, the connection may be affected via a housing portion 306 of the connector 300 or a cable 308.

Figure 4:
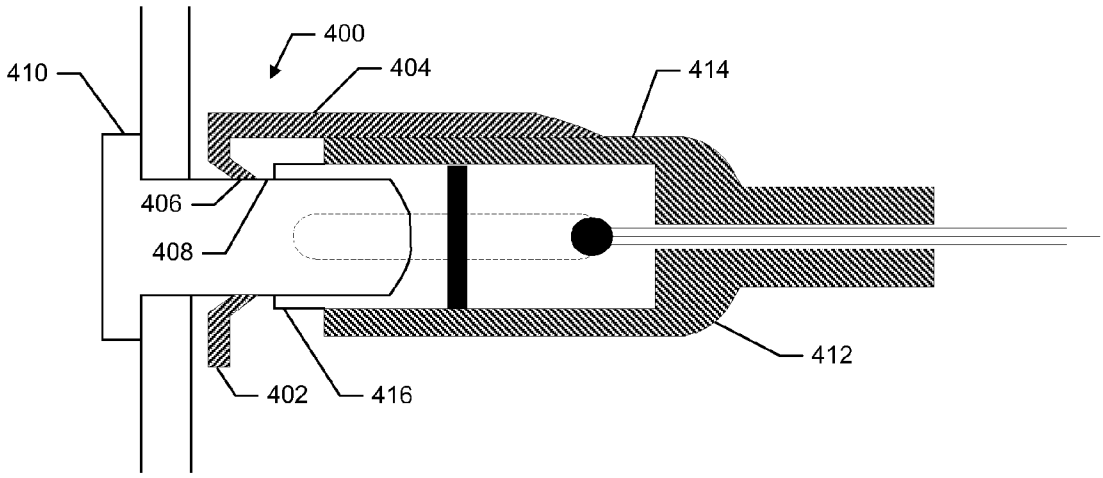
FIG. 4 is a cross sectional view of a third example retainer and a third example connector secured to a third example port.

FIG. 4 illustrates another example retainer 400. In this example, the retainer 400 includes a gripping portion 402, and a support body 404. The gripping portion 402, similar to the gripping portion 104 of FIG. 1, comprises an annular body with an inner surface 406 to engage an outer surface 408 of a receptacle or jack 410. Similar to the support body 102 of FIG. 1, the support body 404 comprises an arm extending from the gripping portion 402 to couple the retainer 400 to a connector 412. In this example, the support body 404 is molded, or otherwise integrated, to the connector 412 to form a unitary body. For example, the support body 404 may be molded to a housing portion 414 of the connector 412.

In the example of FIG. 4, the retainer 400 is molded, or otherwise integrated, to the connector 412 in a manner to allow the gripping portion 402 to engage the jack 410 in front of the connector 412. In other words, when the retainer 400 and the connector 410 are engaged with the jack 410, the gripping portion 402 is positioned beyond the connector 412, in contact with the outer surface of the jack 410. For example, the gripping portion 402 slides onto the outer surface 408 of the jack 410 ahead of any sleeve (e.g., a contact sleeve 416 and/or the housing portion 414) of the connector 412.

When engaged with the jack 410, the retainer 400 substantially reduces the likelihood of accidental disengagement of the connector 412 from the jack 410, as described above.

Figure 5:
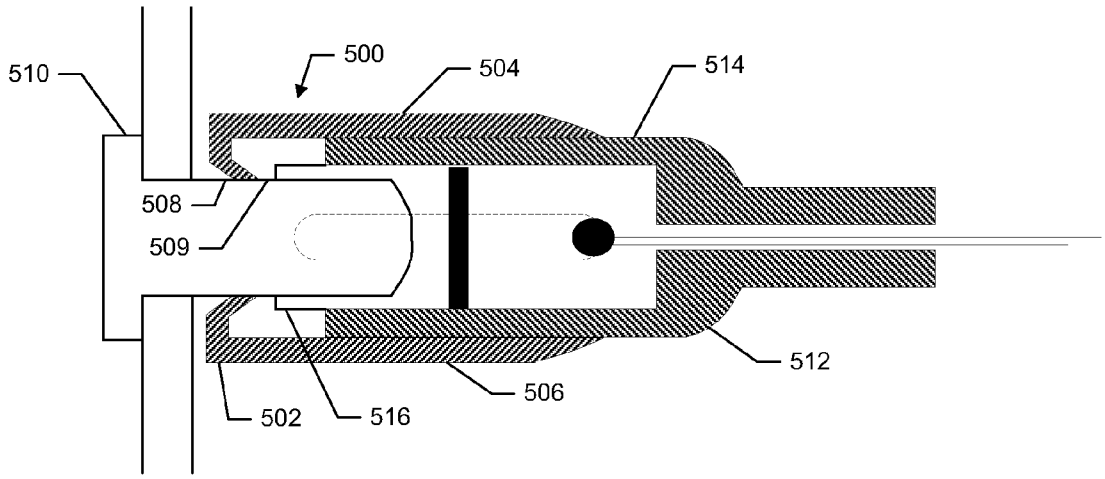
FIG. 5 is a cross sectional view of a fourth example retainer and a fourth example connector secured to a fourth example port.

FIG. 5 illustrates another example retainer 500. In the example of FIG. 5, the retainer 500 includes a gripping portion 502, a first support body 504, and a second support body 506. The gripping portion 502, similar to the gripping portion 104 of FIG. 1, comprises an annular body with an inner surface 508 to engage an outer surface 509 of a receptacle or jack 510. Similar to the support bodies 204 and 206 of FIG. 2, each support body 504 and 506 comprises an arm extending from the gripping portion 502 to couple the retainer 500 to a connector 512. In this example, the support bodies 504 and 506 are positioned substantially 180 degrees apart along the annular gripping portion 502. Further, the support bodies 504 and 506 are molded, or otherwise integrated to the connector 508 to form a unitary body. For example, the support bodies 504 and 506 may be molded to a housing portion 514 of the connector 512.

As described above in connection with FIG. 4, the retainer 500 is molded to the connector 512 in a manner to allow the gripping portion 502 to engage the jack 510 in front of the connector 512. In other words, when the retainer 500 and the connector 512 are engaged with the jack 510, the gripping portion 502 is positioned beyond the connector 512, in contact with the outer surface of the jack 510. For example, the gripping portion 502 slides onto the outer surface 509 of the jack 510 ahead of any sleeve (e.g., a contact sleeve 516 and/or the housing portion 514) of the connector 512. When engaged with the jack 510, the retainer 500 substantially reduces the likelihood of accidental disengagement of the connector 512 from the jack.

Although the example retainers illustrated and described above are shown in use with RCA type connectors, it will be appreciated that the example retainers described herein may be implemented in conjunction with alternative connectors, ports, cables, devices, etc.

Although certain examples apparatus, methods and/or articles of manufacture have been described herein, the scope of coverage of this patent is not limited thereto. On the contrary, this patent covers all apparatus, methods and articles of manufacture fairly falling within the scope of the appended claims either literally or under the doctrine of equivalents.

What is claimed is:

1. An apparatus to secure a connector to a receptacle comprising:

an annular gripping portion to engage an outer surface of a projecting portion of the receptacle, the annular gripping surface being dimensioned to slide onto the outer surface along a longitudinal axis of the receptacle; and a support extending from the gripping portion to be coupled to the connector with the gripping portion located closer to a base of the projecting portion than a sleeve contact of the connector.

2. An apparatus as defined in claim 1, wherein the gripping portion is non-conductive.

3. An apparatus as defined in claim 1, wherein the gripping portion provides a first resistance opposing disengagement of the connector from the receptacle, the first resistance being greater than a second resistance opposing engagement of the connector to the receptacle.

4. An apparatus as defined in claim 1, wherein the gripping portion further comprises a plurality of serrated members.

5. An apparatus as defined in claim 1, wherein the support comprises at least one arm extending away from the base of the receptacle when the gripping portion is seated to the receptacle.

6. An apparatus as defined in claim 1, wherein the support is molded to the connector.

7. An apparatus as defined in claim 1, wherein the fastener is removable.

8. An apparatus as defined in claim 1, wherein the fastener is reusable.

9. An apparatus as defined in claim 1, wherein the connector is an RCA type connector.

10. An apparatus as defined in claim 1, wherein the gripping portion further comprises a plurality of barbs separated by a plurality of gaps.

11. An apparatus as defined in claim 10, wherein the barbs are helically configured.

12. An apparatus as defined in claim 10, wherein the plurality of barbs extend angularly from an inner surface of the gripping portion toward the connector and away from the base of the receptacle.

13. An apparatus as defined in claim 12, wherein the barbs provide a resistance to disengagement of the connector from the receptacle greater than an engagement resistance between the connector and the receptacle.

14. An apparatus as defined in claim 1, wherein the fastener comprises an elastic band.

15. An apparatus as defined in claim 14, wherein the band is continuous.

16. A method of securing a connector to a projecting jack comprising:

engaging an outer surface of the jack with an annular gripping portion of a retainer by sliding the gripping portion onto the outer surface along a longitudinal axis of the jack;

coupling a support body of the retainer to the connector such that the gripping portion is located between at least a sleeve contact of the connector and a base of the jack.

17. A method as defined in claim 16, wherein a resistance opposing disengagement of the connector from the jack is greater than a resistance opposing engagement of the connector to the jack.

18. A method as defined in claim 16, wherein engaging the outer surface comprises engaging the outer surface with a plurality of barbs.

19. A method as defined in claim 18, wherein the barbs extend angularly from an inner surface of the gripping portion toward the connector.

20. A method as defined in claim 19, wherein the barbs resist disengagement of the connector from the jack.

* * * * *

UNITED STATES PATENT AND TRADEMARK OFFICE

CERTIFICATE OF CORRECTION

PATENT NO. : 7,563,123 B2
APPLICATION NO. : 11/864161
DATED : July 21, 2009
INVENTOR(S) : Cave It is certified that error appears in the above-identified patent and that said Letters Patent is hereby corrected as shown below:

Col. 6, line 53: replace "surface being dimensioned" with -- portion being dimensioned --.

Col. 6, line 54: delete "and".

Col. 6, line 58: replace "of the connector" with -- of the connector; and
a fastener to secure the support to the connector, wherein the support comprises a notch to receive at least a portion of the fastener --.

Col. 8, line 12: replace "such that" with -- using a fastener such that --.

Col. 8, line 13: replace "of the jack" with -- , wherein the support body comprises a notch to receive at least a portion of the fastener --.

Signed and Sealed this

Sixteenth Day of March, 2010

David J. Kappos

David J. Kappos
*Director of the United States Patent and Trademark Office*